US005997489A

United States Patent [19]

Iwamoto et al.

[11] Patent Number: 5,997,489

[45] Date of Patent: Dec. 7, 1999

[54] MASSAGER WITH ROTATABLE HEAD AND ROLLER

[75] Inventors: Hironori Iwamoto; Sanai Fukui, both of Sakata-gun; Haruhiko Naruse, Hikone; Keiji Hata, Kyoto; Maki Hirakawa, Suita; Mikio Ito, Hikone, all of Japan

[73] Assignee: Matsushita Electric Works, Ltd., Kadoma, Japan

[21] Appl. No.: 08/817,144

[22] PCT Filed: Aug. 12, 1996

[86] PCT No.: PCT/JP96/02276

§ 371 Date: Apr. 9, 1997

§ 102(e) Date: Apr. 9, 1997

[87] PCT Pub. No.: WO97/06767

PCT Pub. Date: Feb. 27, 1997

[30] Foreign Application Priority Data

| | | | |
|---|---|---|---|
| Aug. 11, 1995 | [JP] | Japan | 7-206291 |
| May 9, 1996 | [JP] | Japan | 8-115063 |

[51] Int. Cl.[6] ..... A61H 15/00; A61H 1/00

[52] U.S. Cl. ..... 601/73; 601/119

[58] Field of Search ..... 601/46, 52, 69, 601/70, 72–73, 78–81, 118, 119, 122, 123, 125, 126, 128–131

[56] References Cited

U.S. PATENT DOCUMENTS

| | | | |
|---|---|---|---|
| 2,441,686 | 5/1948 | Cohen | 128/41 |
| 2,688,960 | 9/1954 | Fischer et al. | 128/36 |
| 2,699,164 | 1/1955 | Stauffer | 128/57 |
| 2,972,347 | 2/1961 | McNair | 128/41 |
| 3,313,296 | 4/1967 | Ruuska | 128/51 |

FOREIGN PATENT DOCUMENTS

| | | | |
|---|---|---|---|
| 3243-621 | 5/1984 | Germany | 601/128 |
| 3241-094 | 4/1985 | Germany | 601/72 |
| 664 486 A5 | 3/1988 | Germany | 601/119 |
| 2-15131 | 1/1990 | Japan . | |
| 5-84328 | 11/1993 | Japan . | |
| 6-442 | 1/1994 | Japan . | |

*Primary Examiner*—Danton D. DeMille
*Attorney, Agent, or Firm*—Armstrong, Wessterman, Hattori, McLeland & Naughton

[57] ABSTRACT

A massager comprises a handle, a roller rotatably supported at one end of the handle and having a peripheral surface adopted to contact a human body, and a vibration generating unit for giving a vibration to the roller. A head for incorporating the vibration generating unit therein is formed at the end of the handle. The roller is disposed on an outer surface of the head to which the vibration is applied. The present massager can selectively provide a vibration massage of applying a vibration to a skin through the roller rolled along the skin, and a vibration massage of applying a vibration to a skin through a peripheral portion of the head pressed against the skin. As a result, it is possible to provide an adequate vibration massage in accordance with the circumstances.

22 Claims, 13 Drawing Sheets

MASSAGER WITH ROTATABLE HEAD AND ROLLER

FIELD OF THE INVENTION

The present invention relates to a handheld-type massager for providing a massage by applying a vibration to a roller adopted to make a rolling contact to a human body.

DISCLOSURE OF THE PRIOR ART

There is a massager comprising a roller supported rotatably at one end of a handle and having a peripheral surface used to contact a human body, and a vibration generating unit for providing a vibration to the roller. In a massager disclosed in Japanese Utility Model Publication No. 5-84328, a vibration is applied to a roller abutted against a surface of the human body and rolled along the body surface to provide a massage and improve blood circulation.

This massager exhibits a good handling property and provides a comfortable massage to a user in case of massaging by rolling the roller. However, when it is desired to provide a vibration massage without rolling the roller while contacting the roller to one portion of the human body, a preferred massage effect can not be obtained because a vibration to be applied to the human body are decreased by a rotation of the roller.

Additionally, in the massager disclosed in this prior art, the vibration generating unit comprising an eccentric weight which can be rotated by a motor is incorporated in the roller, and the roller is disposed such that a rotating axis of the roller is in agreement with the rotating axis of the eccentric weight. When a rotating direction of the roller is reversed, variations of the vibration applied to the human body through the roller occur according to a relationship between the rotating direction of the eccentric weight and a traveling direction of the roller. As a result, a preferred massage effect can not be obtained.

DISCLOSURE OF THE INVENTION

For improving the above problems, a primary object of the present invention is to provide a massager capable of effectively providing a vibration massage while a roller being rolled, and also a vibration massage through a non-rolling portion.

The massager of the present invention comprises a handle, a roller rotatably supported at one end of the handle and having a peripheral surface adopted to contact a human body, and a vibration generating unit for providing a vibration to the roller. A head for incorporating the vibration generating unit therein is formed at the end of the handle. The roller is disposed on an outer surface of the head to which the vibration is applied. Therefore, the massager of the present invention can selectively provide a vibration massage of applying a vibration to a skin through the roller rolled along the skin, and a vibration massage of applying a vibration to a skin through a peripheral portion of the head pressed against the skin. As a result, it is possible to provide an adequate vibration massage in accordance with the circumstances.

When the vibration generating unit is formed with an eccentric weight which can be rotated by a driving unit, and a rotating axis of the roller is in a non-parallel relation with a rotating axis of the eccentric weight, there is an advantage that when a vibration massage is given to a skin through the roller rolled along the skin, it is possible to provide a uniform vibration massage irrespective of the rolling direction. In addition, when the roller is disposed on a peripheral surface of the head in which the eccentric weight is incorporated, and the rotating axis of the roller is spaced away from the rotating axis of the eccentric weight so as not to be crossed with the rotating axis of the eccentric weight, a sufficient amount of vibration energy can be applied to the human body through the roller because the roller is uniformly vibrated as whole. As a result, a preferable and comfortable vibration massage can be obtained.

In addition, when a plurality of rollers are axially aligned, it is possible to provide a uniform vibration massage to a body portion having a small radius of curvature such as arm or foot as well as a body portion having a large radius of curvature such as back.

When a plurality of rollers of different types can be selectively and detachably attached to the head, it is possible to provide an adequate massage motion to a desired portion of the human body.

When a supporting shaft of the roller is made of a flexible material, the roller can be adequately pressed against the skin irrespective of hardness of the roller. When a direction of the rotating axis of the roller is variable, it is possible to readily provide a massage to any of portions of the human body while rolling the roller along the skin. When the present massager comprises a rotation locking unit of the roller, a rotation of the roller can be readily prevented, if necessary.

When the roller is a spheral roller, a point massage effect can be always obtained. When the roller has an angled edge, a higher point-massage massage effect can be obtained. When the head is rotatably supported to the handle such that an orientation of the roller to the handle can be changed by the rotation of the head, it is possible to use the roller and the peripheral surface of the head properly. In particular, it is useful when the handle is of an arcuate form.

It is preferred that a plurality of rollers are axially aligned, and smoothly-projecting portions are formed on a peripheral surface of the respective roller. In this case, when the projecting portions of the rollers are pressed against the skin, the skin is squeezed at a concave between adjacent projecting portions, so that an effective massage can be obtained. In addition, when a rotation locking unit is provided to each of the rollers, massage effects resulting from locked rollers and non-locked rollers can be obtained at the same time.

When a plurality of rollers are axially aligned, or the rollers are detachably supported to the head, rollers having different shapes or hardnesses can be selectively used. As a result, it is possible to readily obtain various massage effects.

When an axial portion of the roller is supported by a hook formed on the head, the roller can be readily exchanged. When the roller is supported by a shaft projecting from the head, only the roller can be exchanged. In case of more than two of the rollers, it is possible to selectively use rollers having different shapes or hardnesses.

It is preferred that the roller is detachable from the head in the opposite direction to a direction of load applied to the roller when the roller is pressed against the skin. Even when a supporting force of the roller is small, it is possible to prevent a falling of the roller from the head during the massage operation. As a result, the roller can be supported to the head by a relatively small supporting force. This means that the roller can be readily detached from the head at the time of exchanging the roller. In addition, since the roller can be readily removed from the head in the detaching direction, it is safe even when hairs be carelessly caught to the roller.

In addition, when the roller is detachably supported to the head such that spheral ends of a rotating shaft of the roller are abutted against concave portions of the head, and a peripheral surface of the rotating shaft is abutted against the concave portion through a flexible material, it is possible to rotatably support the roller by an adequate supporting force, and at the same time prevent the occurrence of a noise resulting from a contact between the roller and a housing of the head during the vibration massage.

When the head has an opened space at a lower side of a mounting position of the roller, a user can remove the roller from the head by pushing out the roller by fingers through the opened space. As a result, the roller can be readily detached from the head.

When a length of the roller in its axial direction is substantially equal to a width of the palm of hand, and a peripheral surface of the roller is provided with four arrays having projections arranged in the axial direction, it is possible to obtain a massage effect which is substantially equal to a hand massage by rubbing.

DETAIL DESCRIPTION OF THE PREFERRED EMBODIMENTS

Figure 1:
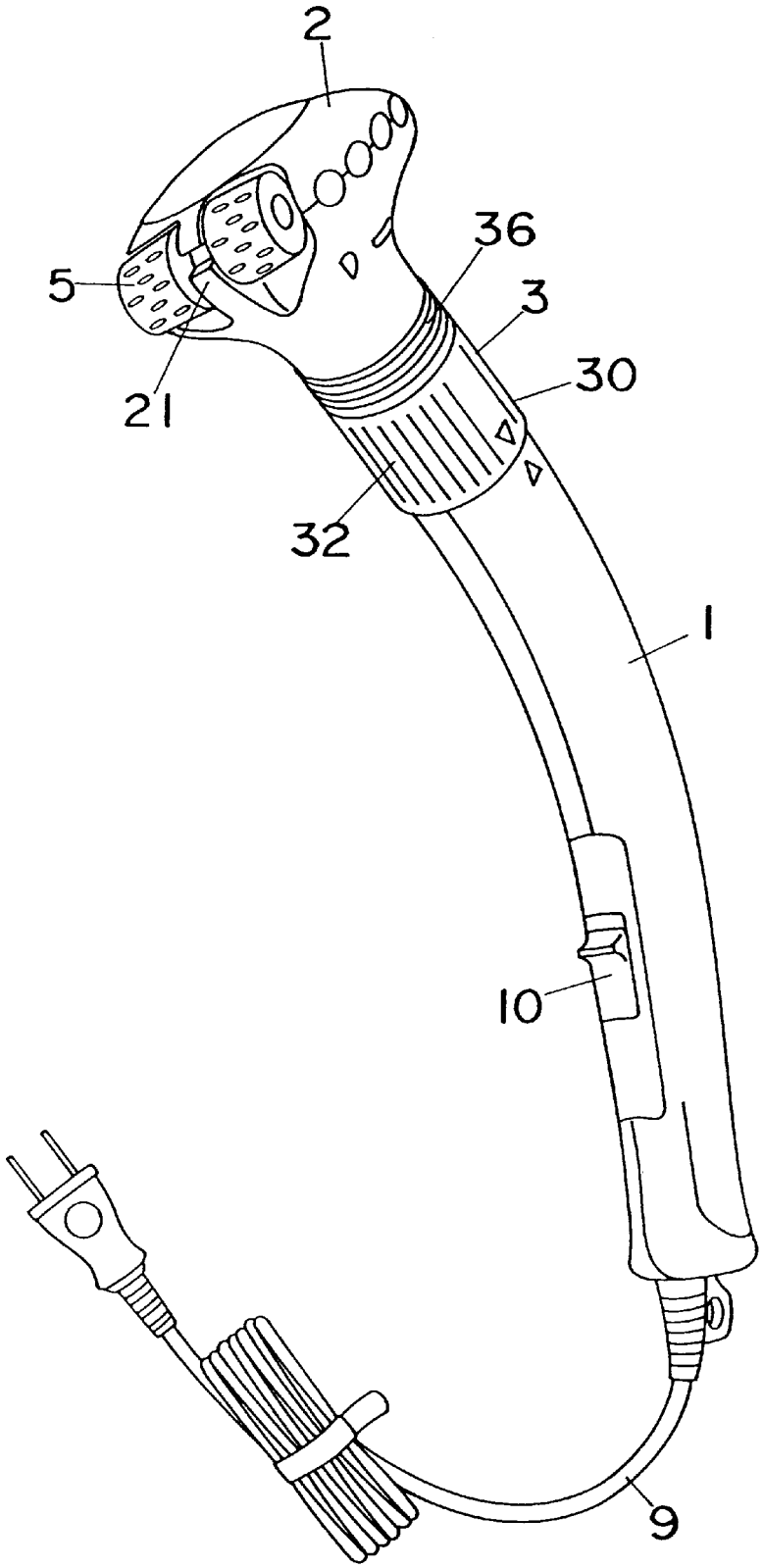
FIG. 1 is a perspective view of a massager according to an embodiment of the present invention.

A massager according to an embodiment of the present invention comprises an handle 1 formed in the shape of an elongate rod and gently bent toward its top end, and a head 2 formed in a disc shape and attached to the top end of the handle 1 through a coupling portion 3. A power, cord 9 extends from the opposite end of handle 1. A power switch 10 is exposed on a surface of the handle 1.

Figures 2A, 2B:
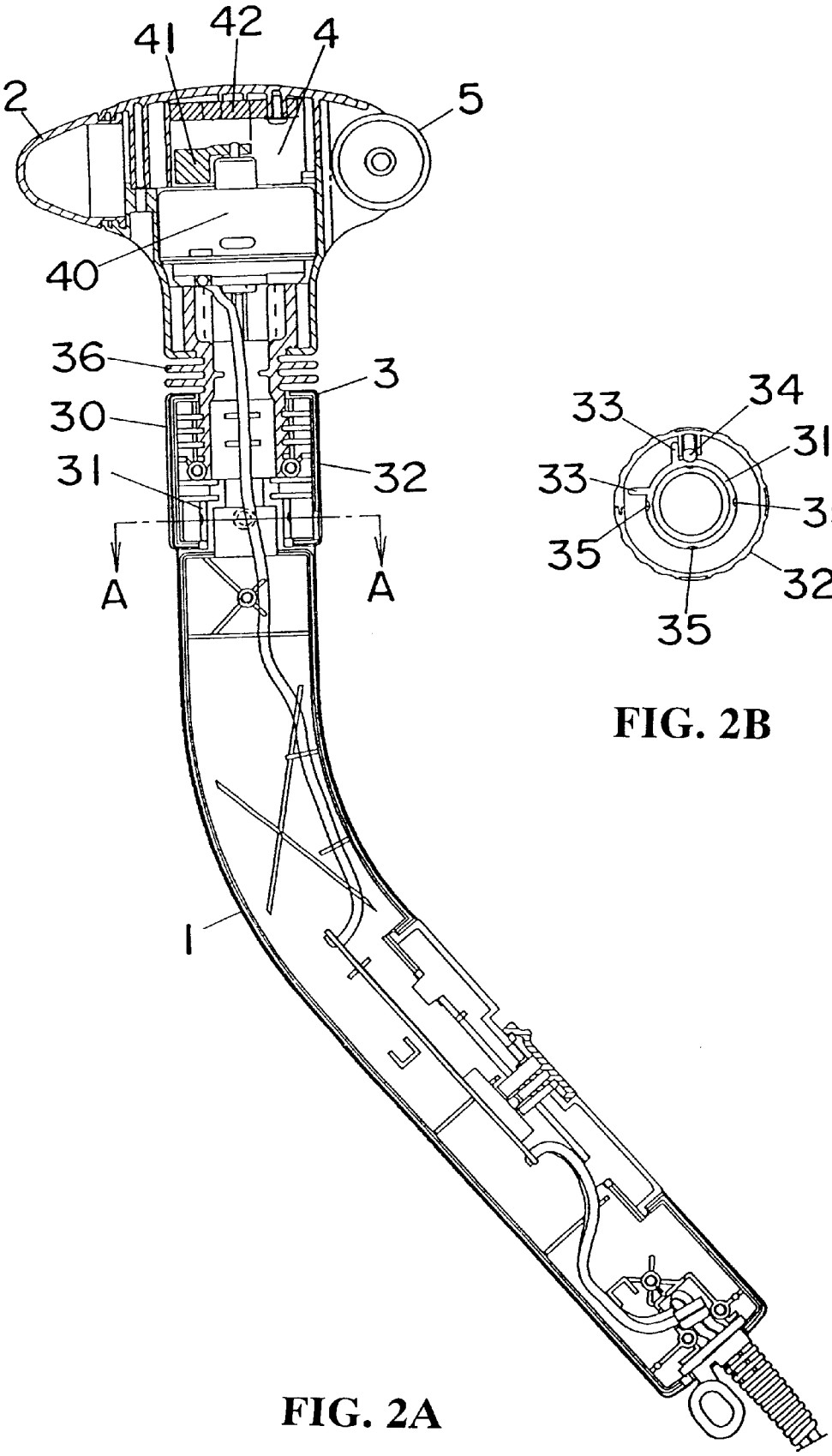
FIG. 2A is a cross-section of the massager.
FIG. 2B is a cross-section taken along line A—A of FIG. 2A.

The coupling portion 3 is formed with a first coupling portion 30 for rotatably supporting the head 2 to the handle 1 about the handle axis, and a second coupling portion 36 made of a flexible material such as a soft synthetic resin. As shown in FIG. 2B, a cylindrical shaft 31 projects from the top end of the handle 1, and a rotatable cover 32 of the head 2 is fitted to an outer surface of the cylindrical shaft 31 so as to be rotatably supported to the handle 1. A rotation range of the cover 32 is limited within 360° by a stopper 33. In this coupling portion 30, a click stop of the head 2 is obtained by an engagement of a spring-biased ball 34 with one of concaves 35 into which the ball 34 can be fitted.

A vibration generating unit 4 built in the head 2 comprises a motor 40, and an eccentric weight 41 fixed to an output shaft of the motor. The head 2 can be vibrated by the eccentric weight 41 rotated by the motor 40. In the attached drawings, numeral 42 designates a balancer for a weight of the motor 40. A roller 5 is supported at a peripheral surface of the disc head 2 so as to be rotatable about its axis.

Figure 3:
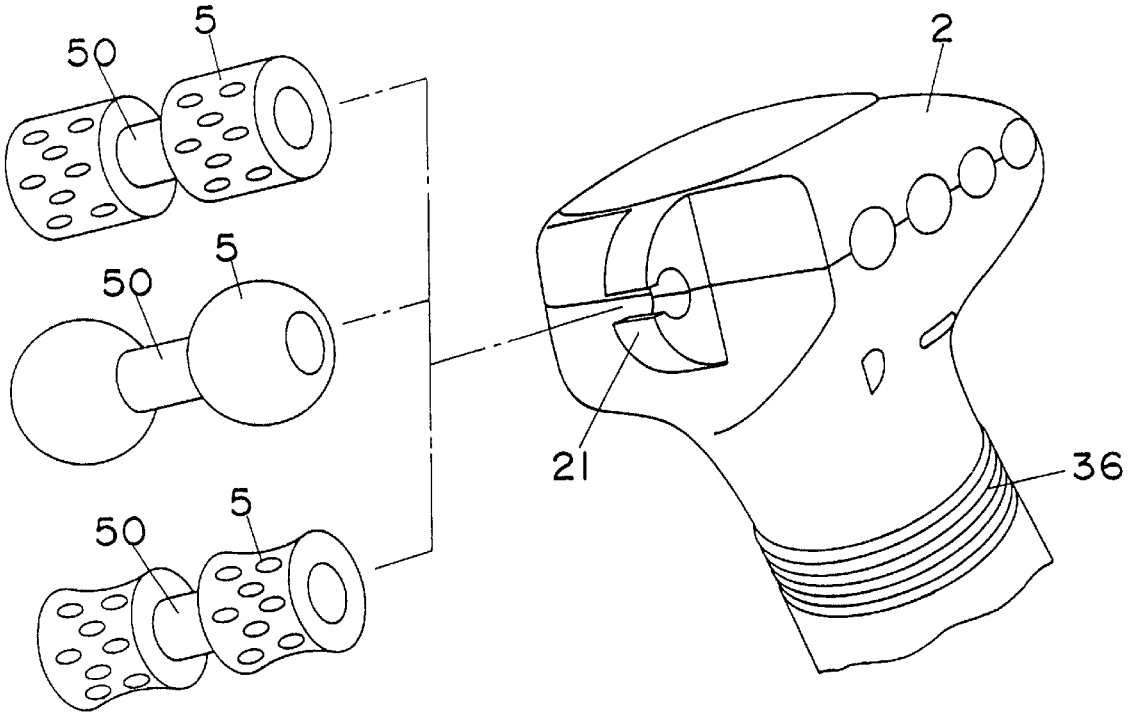
FIG. 3 is a perspective view illustrating rollers of different types which can be used to a massager of the present invention.
Figure 4:
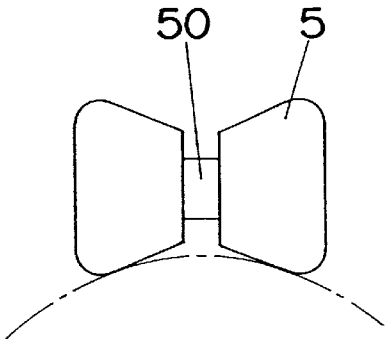
FIG. 4 is a front view of a roller which can be used to the massager.

As shown in FIG. 3, a hook 21 is integrally formed with a housing of the head 2, and a center shaft 50 of the roller 5 is slidably supported to the hook 21 such that the roller is rotatable about an axis of the center shaft. When the roller 5 is attached to the disc head 2, two portions of the roller divided by the center shaft 50 are positioned at the opposite sides of the hook 21. If necessary, it is possible to attach one of rollers 5 of different types shown in FIG. 3 to the hook 21. That is, one of the rollers 5 is a cylinder-like roller having concaves and convexes on its peripheral surface. Another one of the rollers 5 is a spheral-type roller. The last one of the rollers 5 is a drum-type roller having concaves and convexes on its peripheral surface. In addition, it is possible to use a roller having a desired hardness. As shown in FIG. 4, a drum-type roller 5 having flange portions and a center concave defined between the flange portions may be used. In this type, when the roller 5 is pressed against a skin of the human body, the skin held by the flange portions is squeezed at the center concave, so that an effective massage can be obtained.

Since a center of rotation of the eccentric weight 41 of the vibration generating unit 4, that is, an axis of the output shaft of the motor 40, is in agreement with a center axis of the disc head 2, the head can be eccentrically vibrated about the center axis by the rotation of the eccentric weight 41. Therefore, when the peripheral surface of the head 2 is pressed against the skin while the eccentric weight being rotated, a vibration massage can be obtained. In addition, when the roller 5 disposed on the peripheral surface of the head 2 is pressed against the skin, and rolled along the skin while the eccentric weight 41 being rotated, a vibration massage can be provided to the skin through the roller 5.

By the way, since the handle 1 is gently bent, a holding style of the handle for pressing the roller 5 against the skin must be changed when it is desired to press the peripheral surface of the disc head 2 against the skin. However, in the massager of this embodiment, since the disc head 2 is rotatably supported to the handle 1, it is possible to press the roller 5 or the peripheral surface of the disc head 2 against the skin without changing the holding style of the handle.

In this embodiment, a rotating axis of the roller 5 is in a perpendicular relation with the rotating axis of the eccentric weight 41, and the rotating axis of the eccentric weight 41 is spaced away from the rotating axis of the roller 5 such that both rotating axes do not cross each other. There is the following reason for these arrangements.

That is, when a massager having a rotating axis of a roller parallel to that of an eccentric weight is used, and a user repeats to move the massager such that the roller is rolled along a skin, the massager is often moved in the opposite direction to a vibration direction of the eccentric weight. In this moment, the vibration of the eccentric weight 41 are substantially offset, so that a uniform massage effect can not be always provided to the human body through the roller 5. On the contrary, when the present massager having the rotating axis of the roller perpendicular to that of the eccentric weight 41 is used, a uniform massage effect can be obtained without causing the above-described inconvenience.

In addition, when an eccentric weight is disposed in a roller such that a rotating axis of the eccentric weight crosses that of the roller, a total of vibration energy is decreased because opposite end portions of the roller has a different amplitude of vibration from a center portion of the roller. On the other hand, when the roller 5 is disposed on a peripheral surface of the head 2 incorporating the eccentric weight 41 therein, and the rotating axis of the roller is spaced away from that of the eccentric weight such that both rotating axes do not cross each other, the roller 5 provides a substantially uniform vibration as whole, so that a sufficient amount of vibration energy can be transmitted to the human body through the roller. As a result, a preferable and comfortable vibration massage can be obtained.

Figure 5:
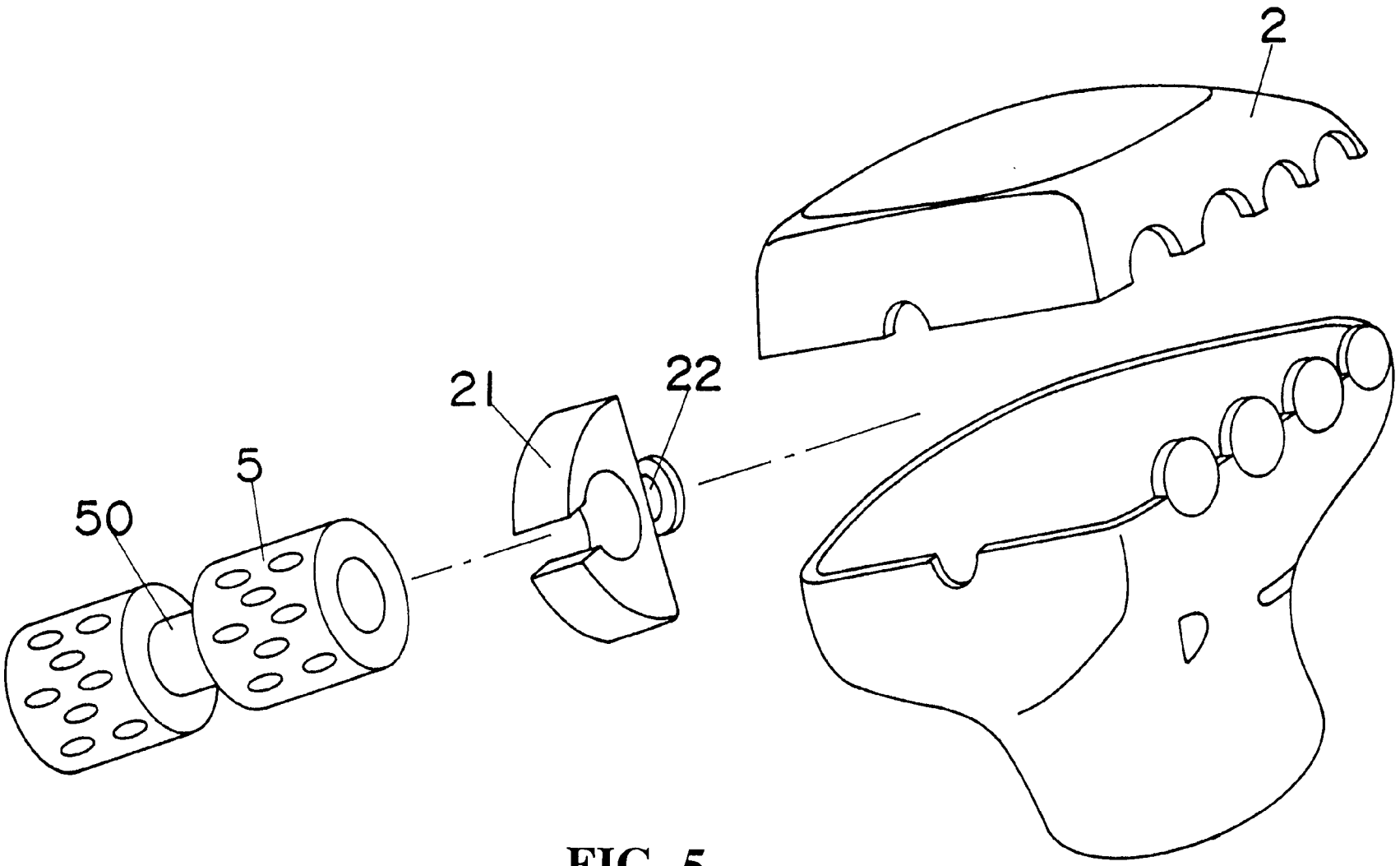
FIG. 5 is an exploded perspective view of a head of the present massager.
Figure 6B:
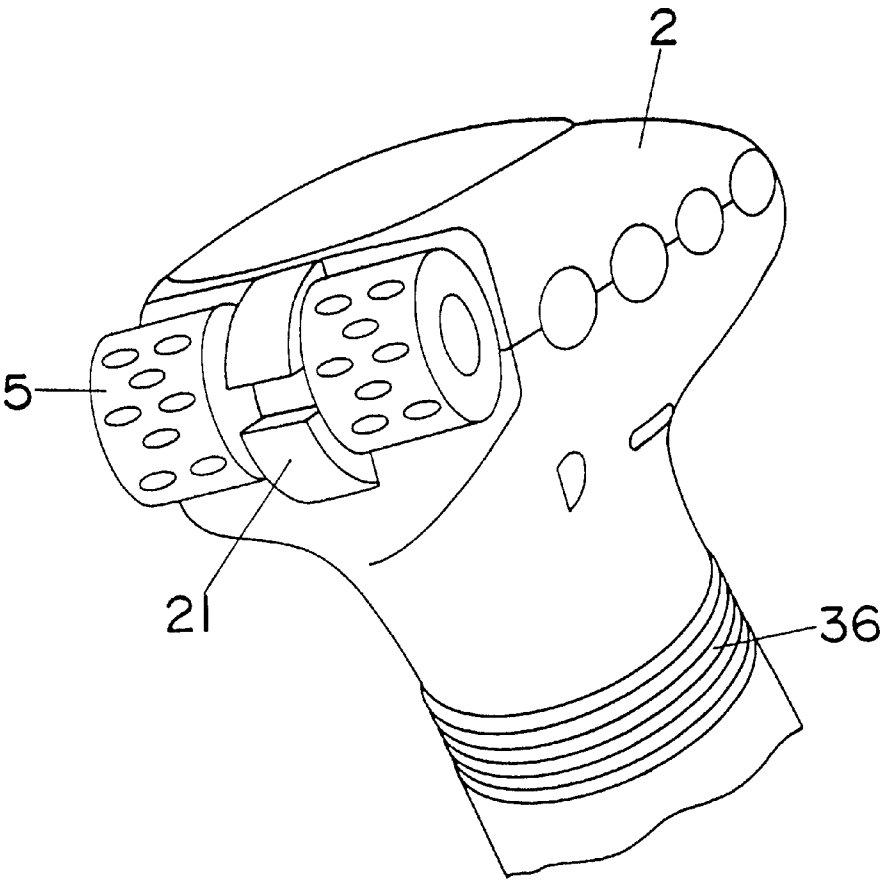
FIGS. 6A and 6B are perspective views explaining an action of the head shown in FIG. 5.
Figure 6A:
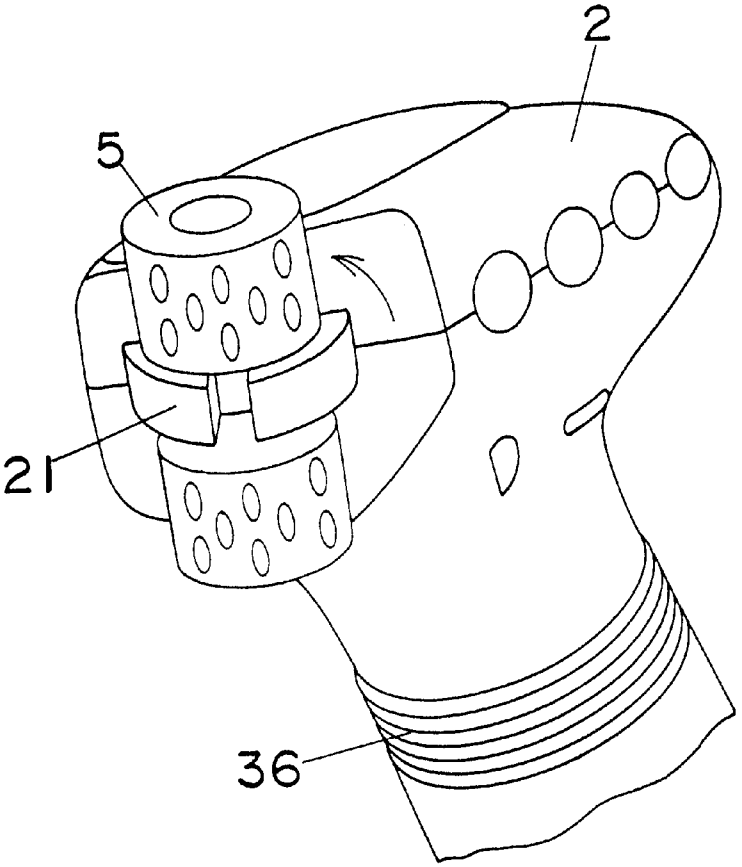

In FIGS. 5, 6A and 6B, a modification of the head 2 is shown. This comprises a hook 21 for supporting the center axis 50 of the roller 5, which is provided with a separate member from the housing of the head 2. A shaft portion 22 of the hook 21 is rotatably supported to the housing such that a direction of the rotating axis of the roller can be changed. As a result, the user can smoothly roll the roller 5 along a skin by changing the direction of the rotating axis of the roller without changing a holding manner of the handle 1.

Figure 7:
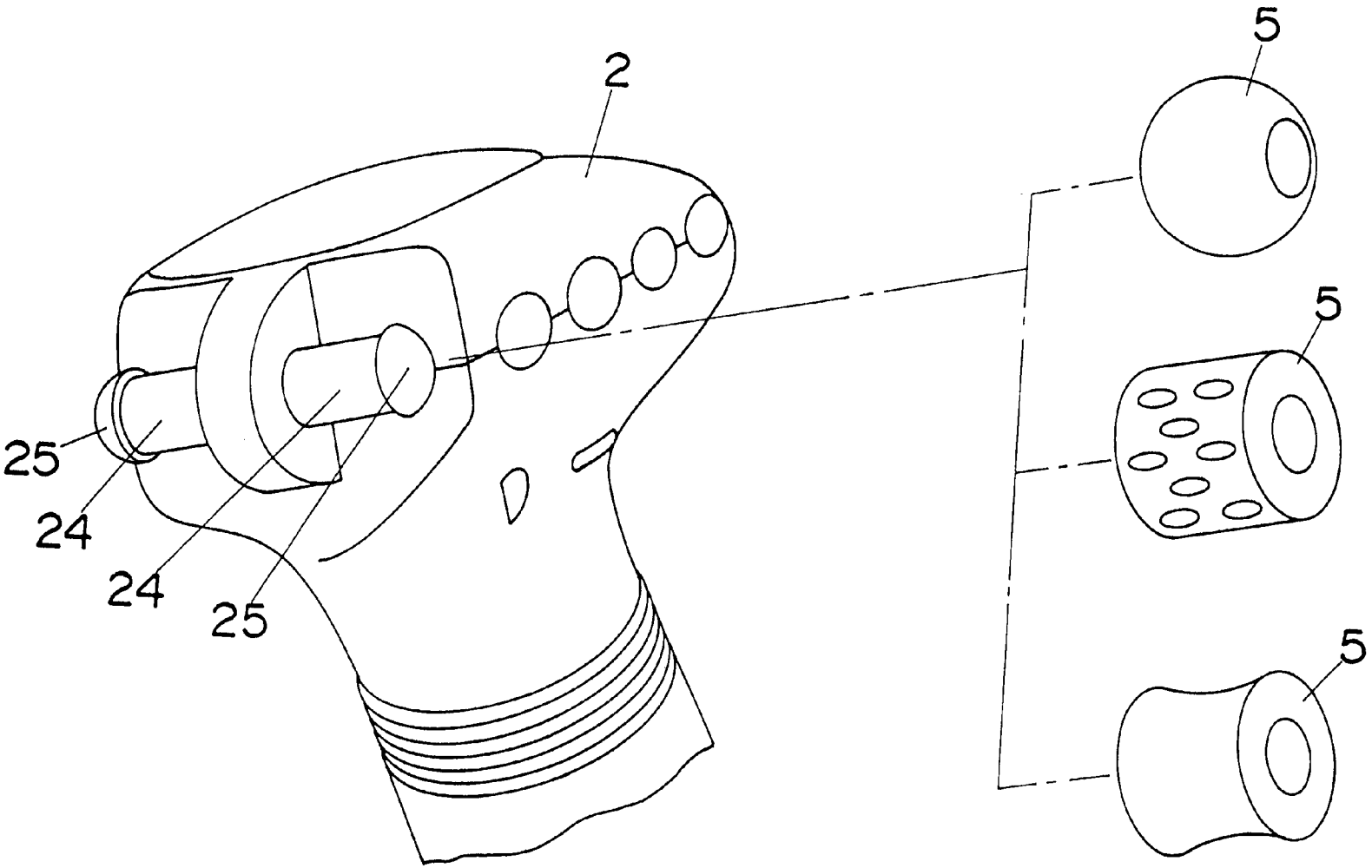
FIG. 7 is a perspective view illustrating rollers of different types which can be used to a massager of the present invention.
Figure 8:
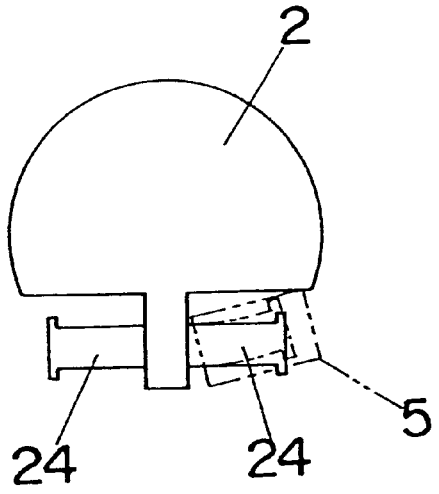
FIG. 8 is a schematic top view of a head of the massager.
Figure 9:
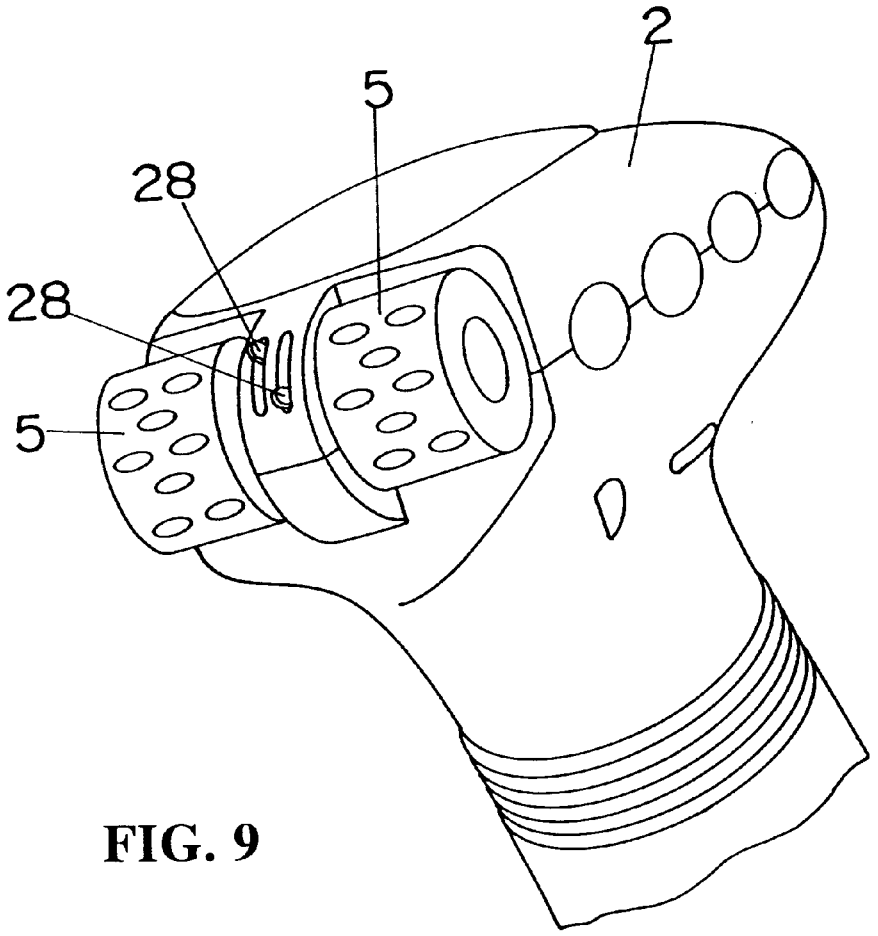
FIG. 9 is a perspective view of a head of a massager of the present invention.
Figure 10:
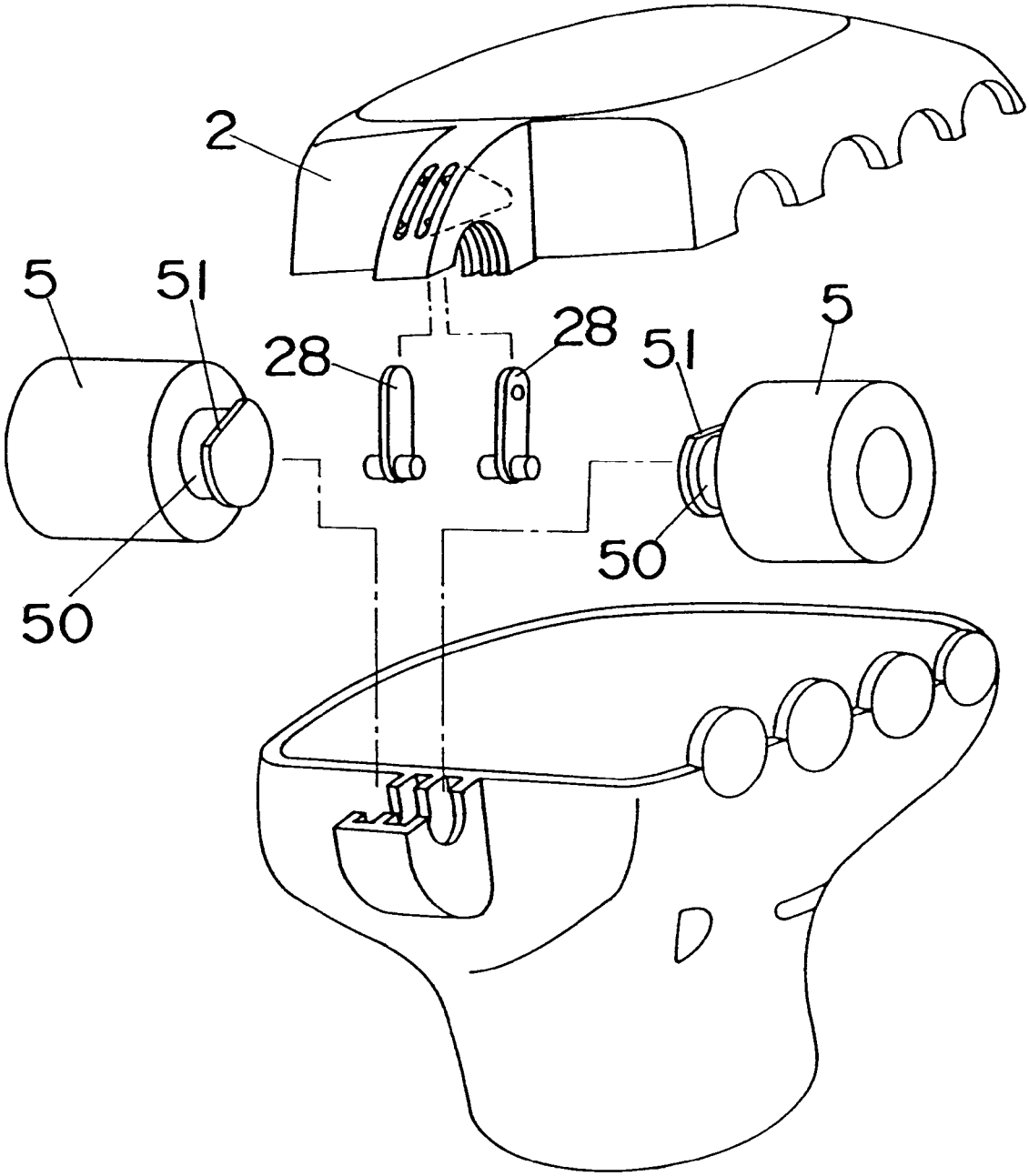
FIG. 10 is an exploded perspective view of the head of FIG. 9.
Figure 11A:
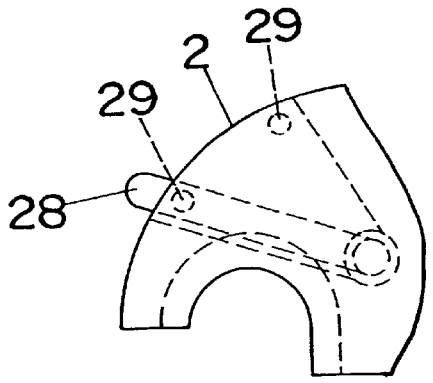
FIGS. 11A and 11B are side view and perspective view illustrating a stopper of the head of FIG. 9, respectively.
Figure 11B:
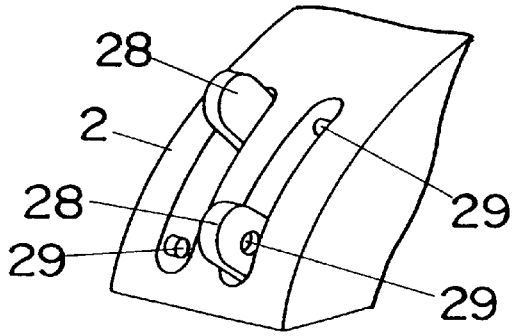
Figure 12:
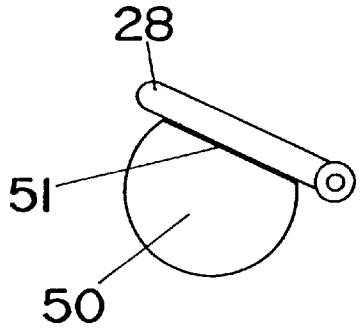
FIG. 12 is a side view illustrating an engagement of the stopper with a linear edge portion of a roller.

FIG. 7 shows another modification of the head 2. The head 2 comprises a pair of shafts 24 each of which has a retainer 25 at its top end. A roller 5 having a hole for receiving the shaft 24 is detachably and rotatably supported to the shaft 24. In this case, two kinds of rollers 5 having different shapes or hardnesses can be attached to the shafts 24. In addition, as shown in FIG. 8, it is preferred that the shafts 24 are made of a flexible material. Even when a roller 5 having a relatively high hardness is attached to the shaft 24, it is possible to match the roller 5 to a skin by a deflection of the shaft 24.

In FIGS. 9 to 12, a further modification of the head 2 is shown. The head 2 comprises a pair of rollers 5 having center shafts 50 rotatably supported to the head 2. Each of the center shafts 50 has a linear edge portion 51 at its top end. The roller 5 can be locked by abutting the linear edge portion 51 against a stopper 28. Therefore, when no rotation of the roller 5 is needed, the roller may be locked by the stopper 28. In particular, in the head 2 shown in the attached drawings, it is possible to selectively lock the rollers 5 by the stoppers 28. For avoiding that the stoppers 28 are carelessly operated, the head 2 comprises a pair of guide grooves along which the stoppers 28 can be moved. In each of the rollers 5, the guide groove and the stopper 28 have engaging portions 29 which are used to switch between a rotatable position and a lock position of the roller 5 according to a concave-convex engagement.

Figure 13:
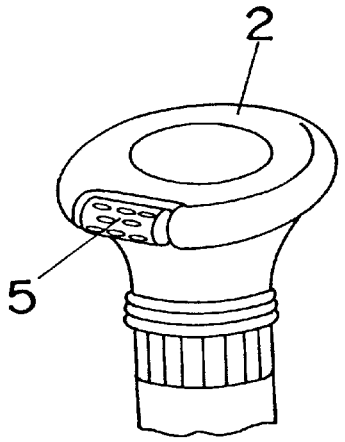
FIG. 13 is a perspective view of a head of a massager of the present invention.
Figure 14:
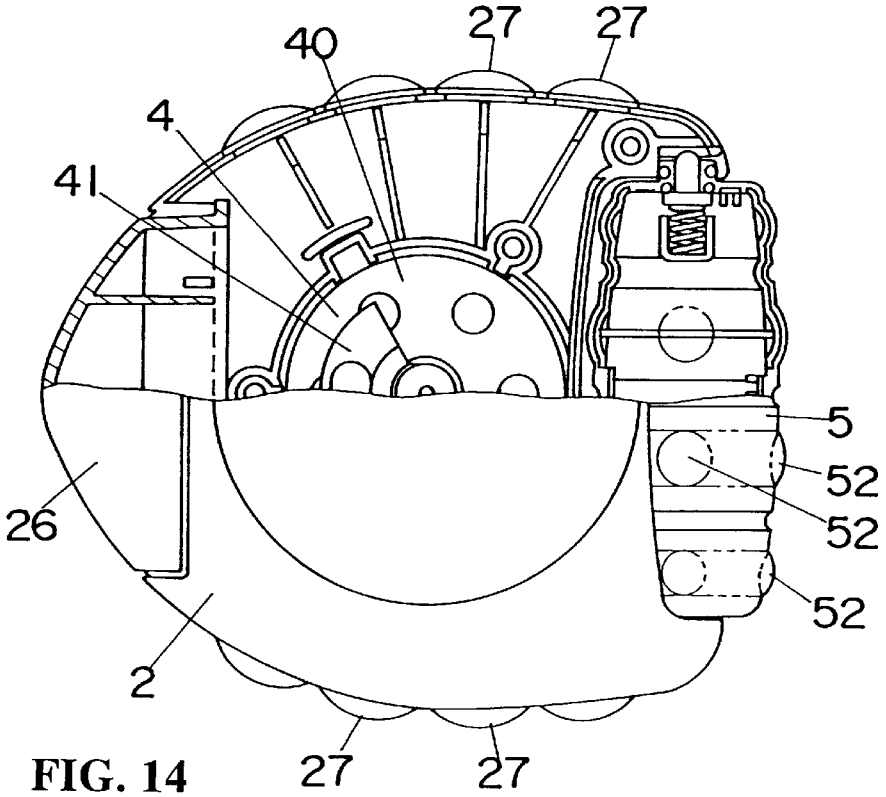
FIG. 14 is a partially cross-sectional view of the head.

In the above embodiment, two rollers 5 are arranged in a straight line including rotating axes. However, as shown in FIG. 13, a single roller may be attached to a head 2. The remaining drawings including FIG. 14 are directed to a massager using the single roller according to the present invention.

Figure 17A:
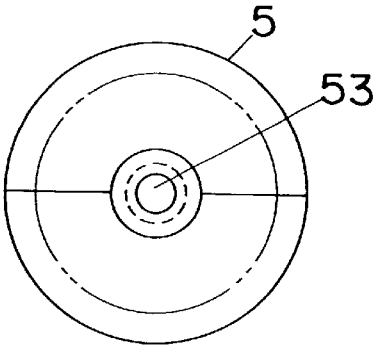
FIGS. 17A and 17B are end view and front view of a roller for the head, respectively.
Figure 17B:
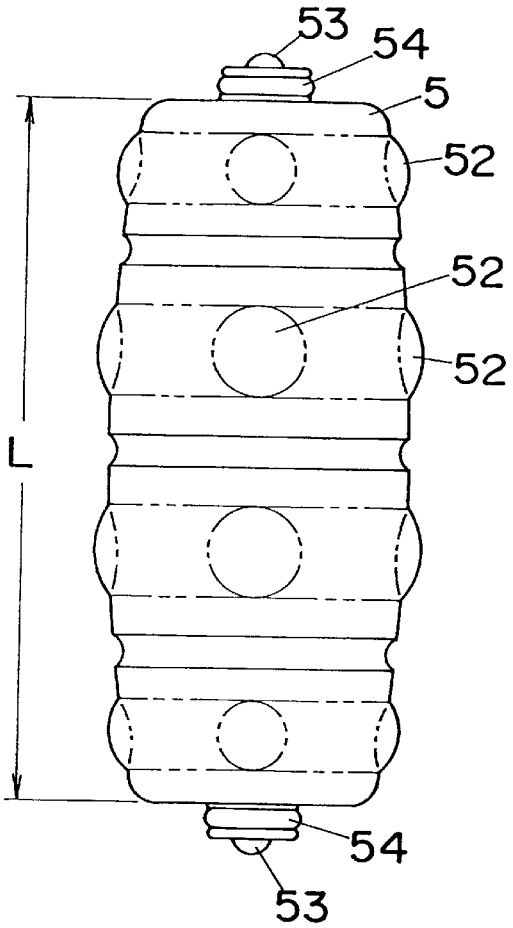
Figure 18:
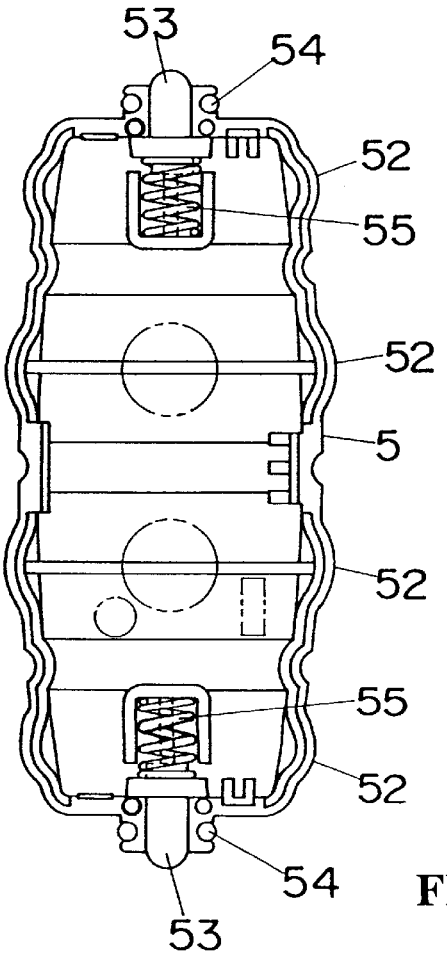
FIG. 18 is a longitudinal section of the roller.
Figure 19:
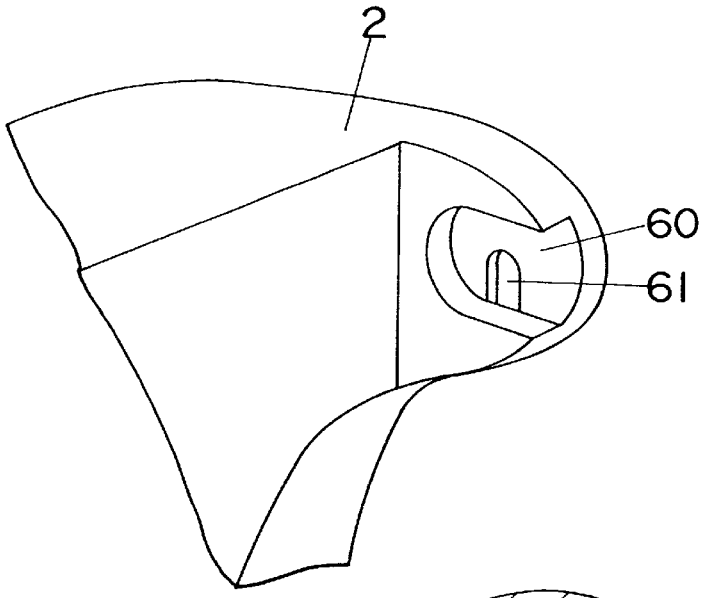
FIG. 19 is a partially perspective view of the head.

The single roller 5 is supported to the head 2 at its opposite end portions so as to be rotatable about its rotating axis. A center portion of the roller 5, which is positioned at the center of the opposite end portions, has a larger diameter than the respective end portion. In addition, the roller 5 is formed with a plurality of arrays having projections 52 on its peripheral surface. In FIG. 14, the roller 5 is formed with four arrays having the projections 52, which are arranged in the axial direction of the roller. Each of the projections 52 of the array is displaced from an adjacent projection of the same array by an interval. As shown in FIGS. 17A, 17B and 18, a pair of shafts 53 project from the opposite end portions of the roller 5. Each of the shafts 53 is biased in the projecting direction by a spring 55. An O-ring 54 is disposed around the respective shaft 53.

Figure 15:
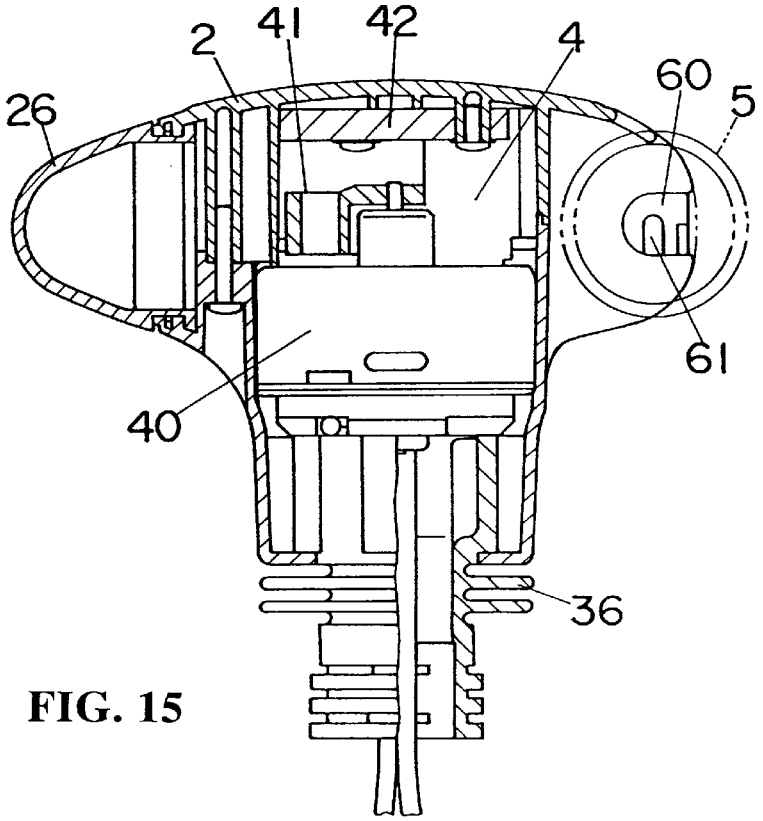
FIG. 15 is a cross-sectional view of the head.
Figure 16:
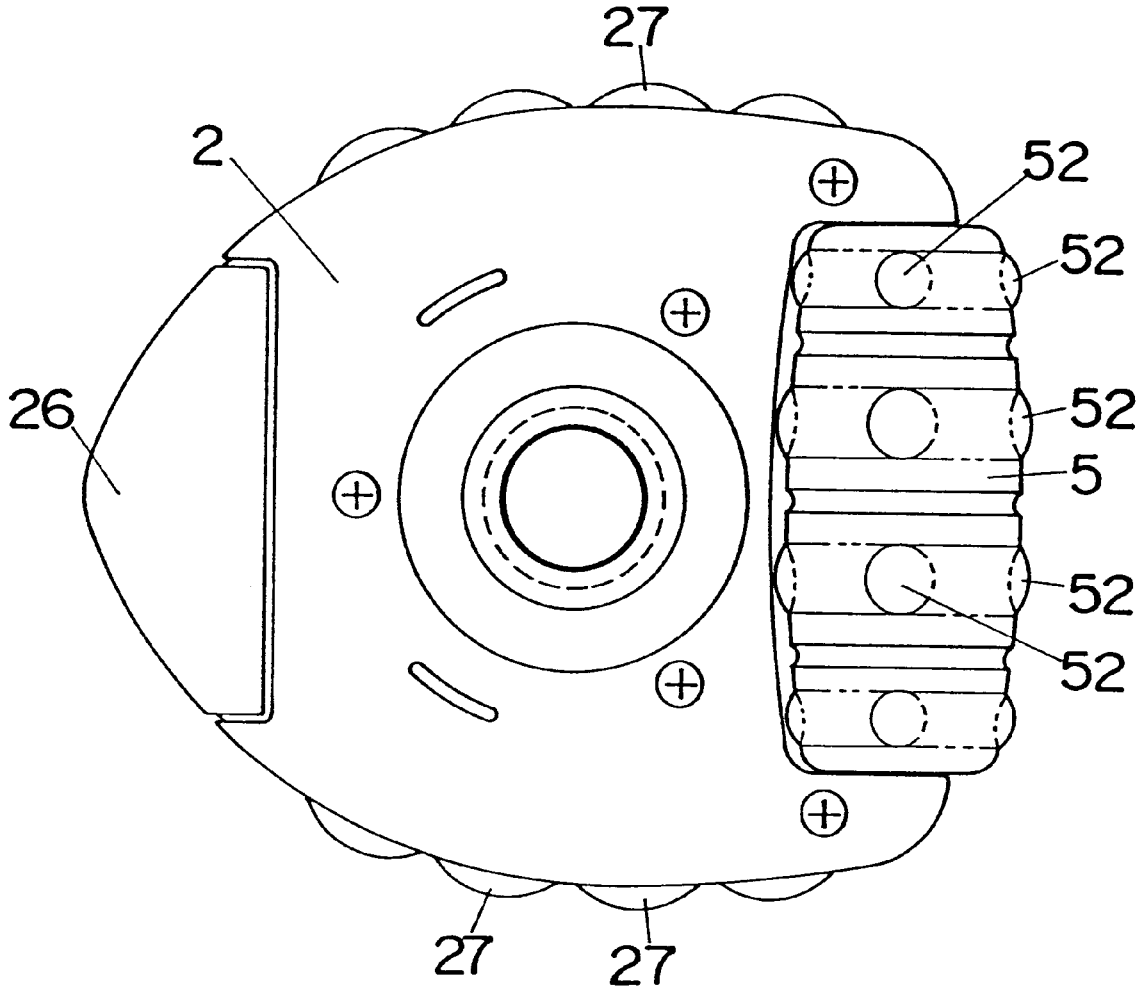
FIG. 16 is a bottom view of the head.
Figure 20:
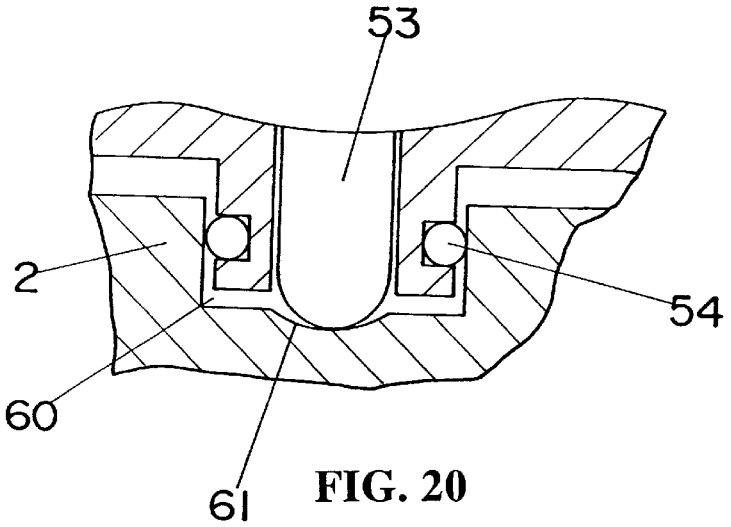
FIG. 20 is a magnified section of a supporting portion of the roller.

The head 2 has a pair of side walls facing each other. The roller 5 is attached to a space between the side walls. As shown in FIGS. 15 is and 19, each of the side walls is formed with a roller guide groove 60 extending to a forward end of the side wall, and an elongate groove 61 extending perpendicularly to a longitudinal direction of the guide groove 60. To attach the roller 5 to the head 2, the shafts 53 of roller 5 are put into the guide grooves 60 through the forward ends of the guide grooves 60, and then spheral ends of the shafts 53 biased by the springs 55 are engaged with the elongate grooves 61, as shown in FIG. 20. In this time, each of the O-rings 54 contacts an inner surface of the guide groove 60. By the use of the O-rings 54 made of the flexible material, the roller 5 can be supported so as to be an adequate rotational force, and at the same time it is possible to prevent the occurrence of a noise resulting from a contact between the roller 5 and the housing of the head 2 during the vibration massage. Alternatively, it is possible to form the elongate grooves 61 in the opposite end portions of the roller 5, and the shafts 53 on the housing of the head 2.

Since each of the guide grooves 60 reaches the forward end of the side wall, the roller 5 can be readily attached to the head 2. In particular, since the roller 5 is detached from the head 2 in the opposite direction to a direction of load applied to the roller when the roller is pressed against a skin, it is possible to prevent a falling of the roller 5 from the head 2 when the roller is pressed against the skin. In addition, it is possible to reduce a force necessary to attach or detach the roller 5. Since the detaching direction of the roller 5 is opposed to the direction of load, the falling of the roller does not occur even when the roller 5 is supported to the head 2 by a relatively small force. Therefore, it is possible to support the roller 5 by a reduced force. In this case, even when hairs are accidentally caught to the roller 5, the caught hairs exert a force to the roller 5 to remove the roller from the head. As a result, a safe massage operation can be obtained. In case of attaching the roller 5 to the head 2 by the use of the hook 21 described above, it is possible to detach the roller from the head according to the similar manner.

Figure 21:
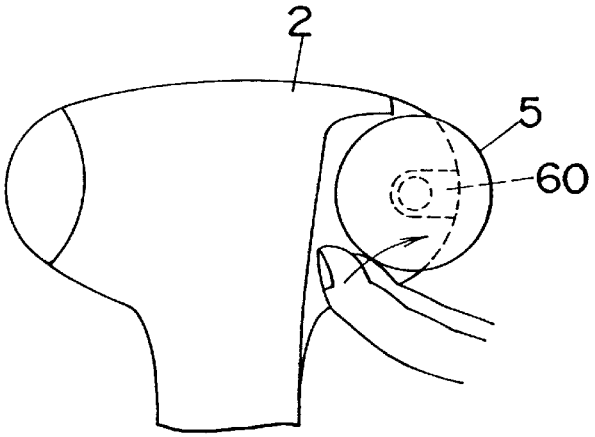
FIG. 21 is an explanatory view showing a detaching operation of the roller from the head.

Since the housing of the head 2 has an opened space at a lower side of a mounting position of the roller 5, the roller can be readily removed from the housing by pulling out the roller by fingers inserted into the opened space, as shown in FIG. 21. In addition, an upper side of the head 2 is formed to partially cover the roller. This is to provide a vibration massage when an upper surface of the head 2, which is a plane substantially parallel to the vibration direction of the head 2, is pressed against a skin while the eccentric weight 41 being rotated. Moreover, a massage portion 26 having a relatively-sharpened projection for a point-massaging is formed on a rear end of the head 2. A plurality of projecting portions 27 are formed on a peripheral surface of the head 2 except for the massage portion 26 to improve the massage effect.

Figure 22:
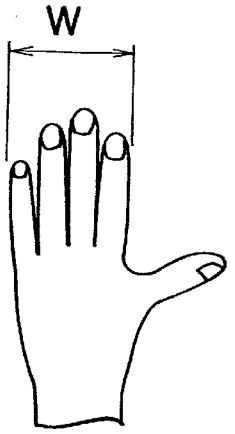
FIG. 22 is an explanatory view showing a width of the palm of hand.

It is preferred that a length of the roller 5 in the axial direction is determined in a range of 50 to 80 mm, which is substantially equal to a width of the palm of hand, as shown in FIG. 22. In this case, it is possible to obtain a massage effect which is substantially same as a hand massage by rubbing. The above-explained roller 5 is provided with four arrays having the projections 52. Four projections 52 of the arrays are arranged on a straight line along the axial direction of the roller 5 to imitate a rubbing massage carried out by the bulbs of four fingers.

Industrial Applicability

As explained above, a massager of the present invention is useful to cure a stiff shoulder or lumbago, etc., and adequate for a private use.

What is claimed is:

1. A massager comprising:

a handle;

vibration generating means;

a head for incorporating said vibration generating means; said head being disposed at one end of said handle;

a roller having a peripheral surface adopted to contact a human body, said roller rotatably supported to said head about a roller axis coupling means for rotatably supporting said head to said handle about an handle axis;

wherein said head has a first massage portion where vibration of said vibration generating means is applied to a user through said roller, and a second massage portion where said vibration is applied to the user through a projection formed on said head.

2. A massager as set forth in claim 1, wherein said vibration generating means is formed with an eccentric weight which can be rotated by a driving means, and a rotating axis of said roller is spaced away from a rotating axis of said eccentric weight so as to be in a non-parallel relation with the rotating axis of said eccentric weight.

3. A massager as set forth in claim 1, including a plurality of rollers which are axially aligned.

4. A massager as set forth in claims 1 or 3, including a plurality of rollers of different type, the rollers selectively and detachably attached to said head.

5. A massager as set forth in claim 1, wherein a supporting shaft of said roller is made of a flexible material.

6. A massager as set forth in claim 1, wherein said roller is affixed to the head such that a rotating axis thereof is rotatably variable in direction variable.

7. A massager as set forth in claim 1 further including a rotation locking means for said roller.

8. A massager as set forth in claim 1, wherein said roller is a spheral roller.

9. A massager as set forth in claim 1, wherein said roller has an outer angled circumferential edge. edge.

10. A massager as set forth in claim 1, wherein said head is rotatably supported to said handle, so that an orientation of said roller to said handle can be changed by the rotation of said head.

11. A massager as set forth in claim 3, wherein smoothly projecting portions are formed on a peripheral surface of each of said rollers.

12. A massager as set forth in claim 3 comprising a rotation locking means peculiar to each of said rollers.

13. A massager as set forth in claim 3, wherein one of said rollers has a shape different from another of said rollers.

14. A massager as set forth in claim 3, wherein one of said rollers has a hardness different from another of said rollers.

15. A massager as set forth in claim 4, wherein an axial portion of each of said rollers is supported by a hook formed on said head.

16. A massager as set forth in claim 4, wherein each of said rollers is supported by a shaft projecting from said head.

17. A massager as set forth in claim 1, further including means for releasably attaching said roller to said head such that said roller is detached in the opposite direction to a direction of force applied to said roller when said roller is pressed against a skin.

18. A massager as set forth in claim 4, wherein spheral ends of a rotating shaft of said roller are abutted against concave portions of said head to support said roller to said head, and a peripheral surface of said shaft is abutted against said concave portions through a flexible material.

19. A massager as set forth in claim 4, wherein an opened space is provided between said head and a lower side of said roller.

20. A massager as set forth in claim 1, wherein a length of said roller in its axial direction is substantially equal to a width of the palm of hand, and a peripheral surface of said roller is provided with four arrays arranged in said axial direction, each array being of at least three projections located radially about that roller.

21. A massager comprising:

a handle;

a roller having a peripheral surface adopted to contact a human body, said roller rotatably supported at one end of said handle and having a rotation locking means; and a vibration generating means for providing a vibration to said roller; wherein said vibration generating means is incorporated in a head which is formed at the end of said handle, and said roller is disposed on an outer surface of said head to which said vibration is applied.

22. A massager comprising:

a handle;

a plurality of axially aligned rollers, each roller having a peripheral surface adopted to contact a human body and having a rotation locking means, said rollers rotatably supported at one end of said handle; and a vibration generating means for providing a vibration to said rollers; wherein said vibration generating means is incorporated in a head which is formed at the end of said handle, and said rollers are disposed on an outer surface of said head to which said vibration is applied.

* * * * *